US006247429B1

(12) United States Patent
Hara et al.

(10) Patent No.: US 6,247,429 B1
(45) Date of Patent: Jun. 19, 2001

(54) COOLING WATER CIRCULATING APPARATUS

(75) Inventors: Naohiro Hara, Chita-gun; Yasuo Ozawa, Kariya, both of (JP)

(73) Assignee: Aisin Seiki Kabushiki Kaisha, Aichi-Pref (JP)

( * ) Notice: Subject to any disclaimer, the term of this patent is extended or adjusted under 35 U.S.C. 154(b) by 0 days.

(21) Appl. No.: 09/466,775

(22) Filed: Dec. 20, 1999

(30) Foreign Application Priority Data

Dec. 18, 1998 (JP) ..... 10-360998

(51) Int. Cl.[7] ..... F01P 5/10
(52) U.S. Cl. ..... 123/41.44; 123/41.1
(58) Field of Search ..... 123/41.1, 41.44, 123/198 C

(56) References Cited

U.S. PATENT DOCUMENTS 3,999,598 * 12/1976 Fehr et al. ..... 165/42
4,369,738 * 1/1983 Hirayama ..... 123/41.1
4,768,484 * 9/1988 scarselletta ..... 123/41.21
6,199,518 * 3/2001 Hotta et al. ..... 123/41.44

FOREIGN PATENT DOCUMENTS 9-88582 3/1997 (JP) .

* cited by examiner

*Primary Examiner*—Henry C. Yuen
*Assistant Examiner*—Katrina B. Harris
(74) *Attorney, Agent, or Firm*—Reed Smith Hazel & Thomas LLP

(57) ABSTRACT

The present invention provides a cooling water circulating apparatus capable of securing a required flow rate of cooling water without increasing the heads of water pumps. The apparatus includes a first water pump which has a first supply port for supplying the cooling water into the first water pump, the cooling water for flowing through the interior of an engine, and a first discharge port for discharging the supplied cooling water from the first water pump to the engine again, and which is directly connected to and rotated with a cam shaft of the engine. A control mechanism is adapted to cut off a flow of the cooling water, which is directed from a radiator to the first supply port, when the temperature of the cooling water is not higher than a predetermined level, and operatively connect the radiator and first supply port with each other when the temperature of the cooling water is higher than the predetermined level. A second water pump includes a second supply port for supplying the cooling water from the second water pump to flow through the interior of the engine, and a second discharge port for discharging the supplied cooling water from the second water pump to the supply port of the first water pump. The second water pump is not rotated when the temperature of the cooling water is not higher than a predetermined level, and is electrically rotated when the temperature of the cooling water is higher than the predetermined level.

6 Claims, 4 Drawing Sheets

COOLING WATER CIRCULATING APPARATUS

BACKGROUND OF THE INVENTION

1. Field of the Invention

This invention relates to a cooling water circulating apparatus adapted to send out cooling water flowing there into an engine or a radiator by a water pump.

2. Description of the Related Art

The known cooling apparatuses for internal combustion engines include an apparatus disclosed in Japanese Patent Laid-Open No. 88582/1997. The techniques included in this apparatus are to reduce the limitation placed on the arrangement of various auxiliary machines driven via a crankshaft, a belt and a chain, by driving a cooling water supply pump by a cam shaft, fixing the water pump to a cylinder head so as to join a discharge port of the water pump to an inlet port of a cooling water passage on a suction side of the cylinder head, thereby forming the suction side cooling water passage as a water passage on a discharge side of the water pump, whereby, even when the resistance of the suction side cooling water passage is large, negative pressure on a suction side of the water pump increases to prevent the occurrence of cavitation therein.

However, in such a related art apparatus, the cooling water is circulated by a water pump alone which is driven by a cam shaft rotated with a rotational frequency ½ times as high as that of the crankshaft, so that, when the temperature of the cooling water increases higher than a predetermined level, a required flow rate of the cooling water cannot be secured unless the capacity of the water pump is increased. In order to secure a required flow rate of the cooling water, the cooling water discharge performance (head) of the pump has to be improved, and, in order to increase the pump head, the dimensions of the water pump have to be increased. This causes a driving force of the water pump to increase, so that the fuel consumption also increases.

SUMMARY OF THE INVENTION

Therefore, the technical problem to be solved by the present invention is how to provide a cooling water circulating apparatus capable of securing a required flow rate of cooling water without increasing the heads of water pumps.

To solve the problem, a first aspect of the invention provides a cooling water circulating apparatus adapted to circulate cooling water through an engine or a radiator, including a first water pump which has a first supply port for supplying thereinto cooling water which is to flow through the interior of an engine, and a first discharge port for discharging therefrom the supplied cooling water to the engine again, and which is connected to and rotated with a cam shaft of the engine, a control mechanism adapted to cut off a flow of the cooling water, which is directed from a radiator to the first supply port, when the temperature of the cooling water is not higher than a predetermined level, and communicate the radiator and first supply port with each other when the temperature of the cooling water is higher than the predetermined level, and a second water pump which has a second supply post for supplying thereinto cooling water which is to flow through the interior of the engine, and a second discharge port for discharging therefrom the supplied cooling water to the supply port of the first water pump, and which is electrically rotated in accordance with the temperature of the cooling water.

According to the first aspect of the invention, when the temperature of the cooling water is not higher than a predetermined level, the first water pump is rotated with the cam shaft of the engine, receives the supply of cooling water from the first supply port and discharges the same toward the first discharge port. The discharged cooling water cools the engine on the inner side thereof. When the temperature of the cooling water becomes higher than a predetermined level, the radiator and first supply port are communicated with each other by the control mechanism, and the cooling water discharged from the first water pump is supplied to the engine and radiator. Since the cam shaft is rotated with a rotational frequency ½ times as high as that of the crankshaft, it is considered that, when the cooling water is discharged to the engine and radiator, a discharge rate of the first water pump decreases in some cases. According to the invention, the second water pump is rotated electrically in accordance with the temperature of the cooling water. Therefore, when the driving of the first water pump alone causes a discharge rate of the cabling water to decrease, the second water pump is rotated to enable the shortage of the discharge rate to be filled up. Owing to this operation, a suitable quantity of cooling water can always be circulated. Since the second water pump is electrically operated, the rotational frequency thereof can be controlled, and the flow rate of the cooling water can also be arbitrarily regulated.

A case where the second water pump is set so that it is not rotated when the temperature of the cooling water is not higher than a predetermined level, and rotated electrically when the temperature of the cooling water is higher than a predetermined level as described in the statement of a second aspect of the invention will be discussed. When the temperature of the cooling water becomes higher than a predetermined level, the second water pump is driven, and the control mechanism communicates the radiator and first supply port with each other. Consequently, the cooling water is supplied from the second supply port, and discharged from the second discharge port.

Since the cooling water is thus circulated at a required flow rate through both the engine and radiator by rotating the electrically driven second water pump, it becomes possible to secure a required flow rate of the cooling water without increasing the dimensions of the first water pump even when the first water pump is driven with the cam shaft.

DESCRIPTION OF THE PREFERRED EMBODIMENT

Figure 1:
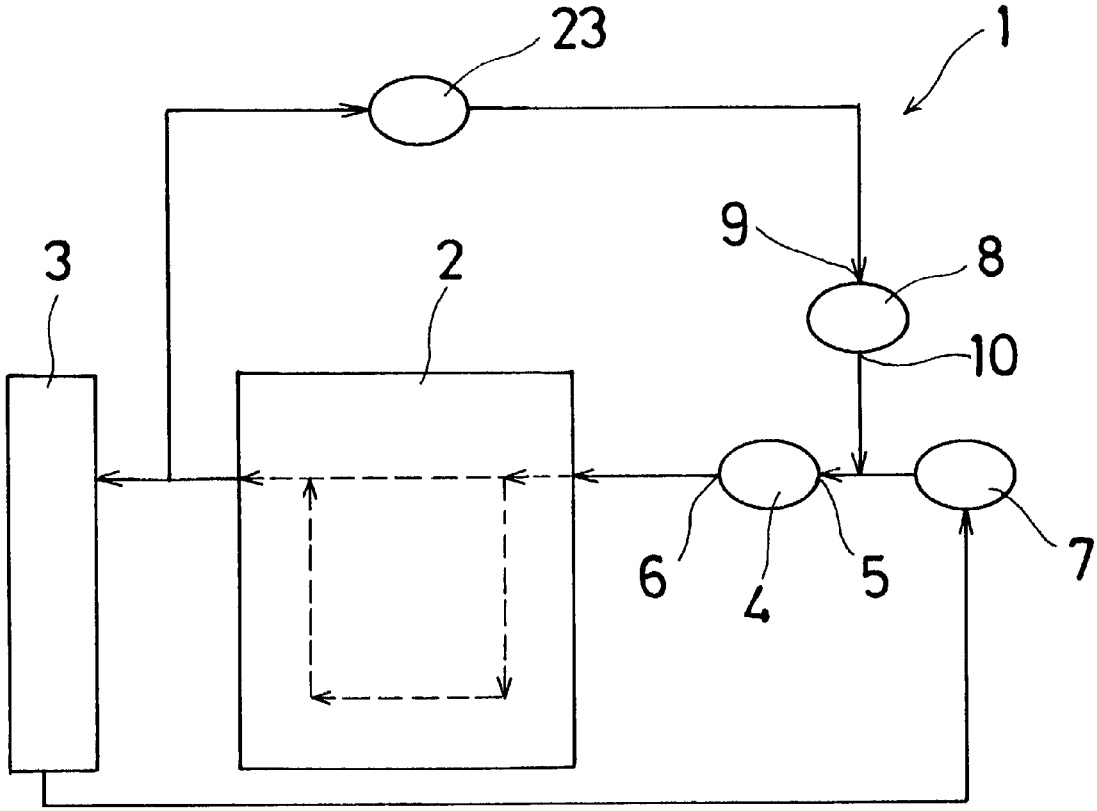
FIG. 1 is a system diagram of a mode of embodiment of the cooling water circulating apparatus according to the present invention.
Figure 2:
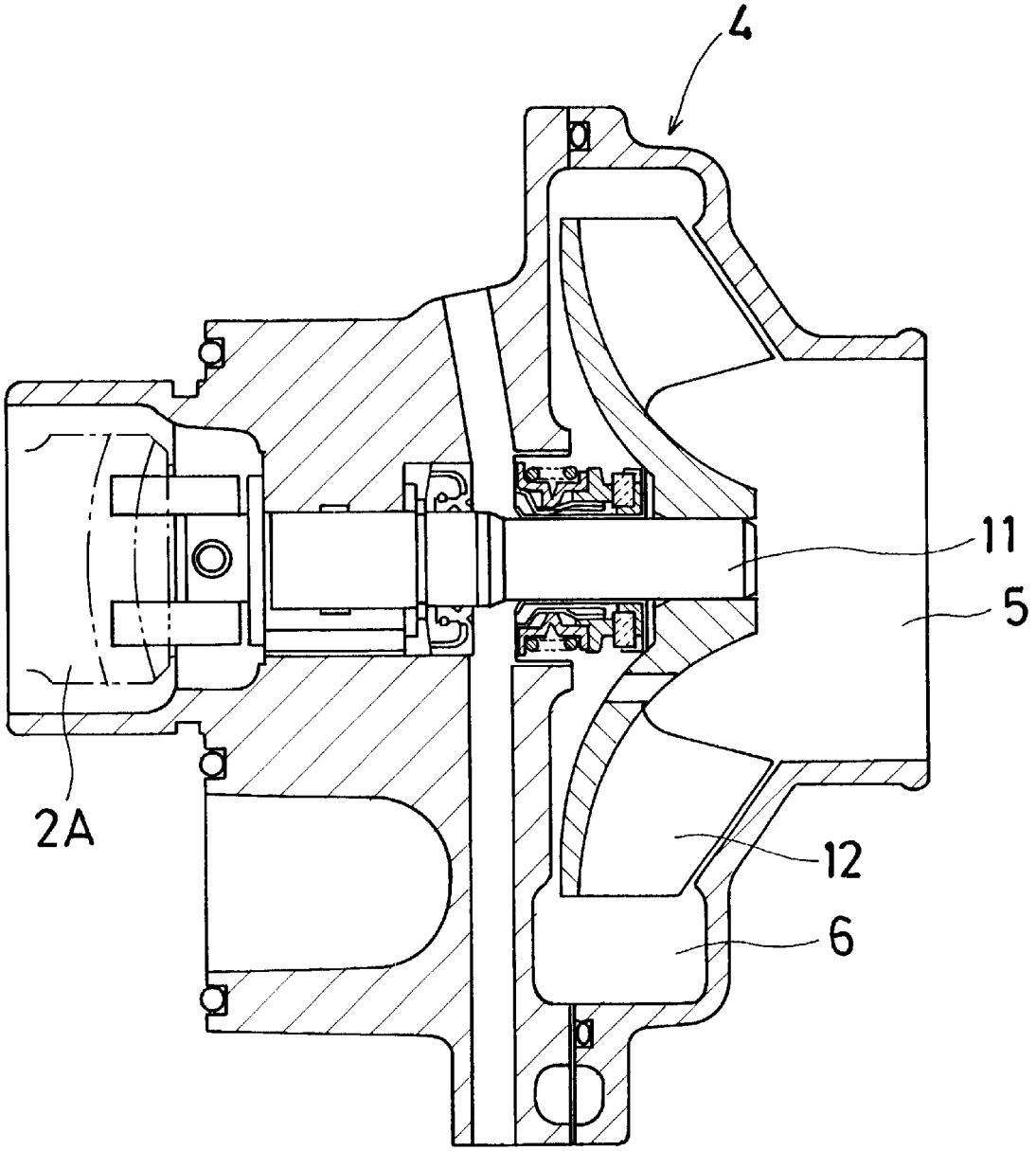
FIG. 2 is a sectional view of a first water pump in the mode of embodiment.
Figure 3:
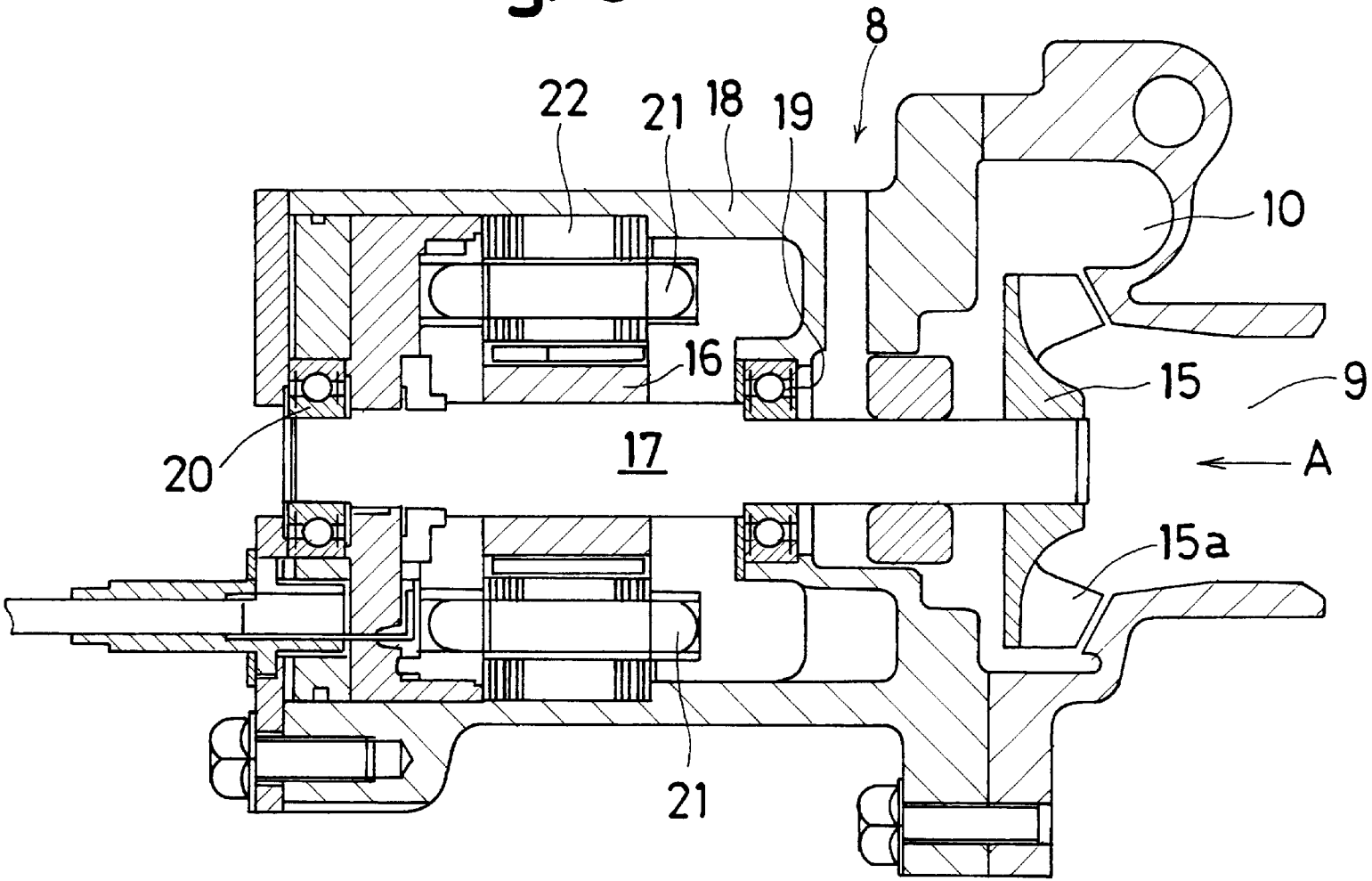
FIG. 3 is a sectional view of a second water pump in the mode of embodiment.
Figure 4:
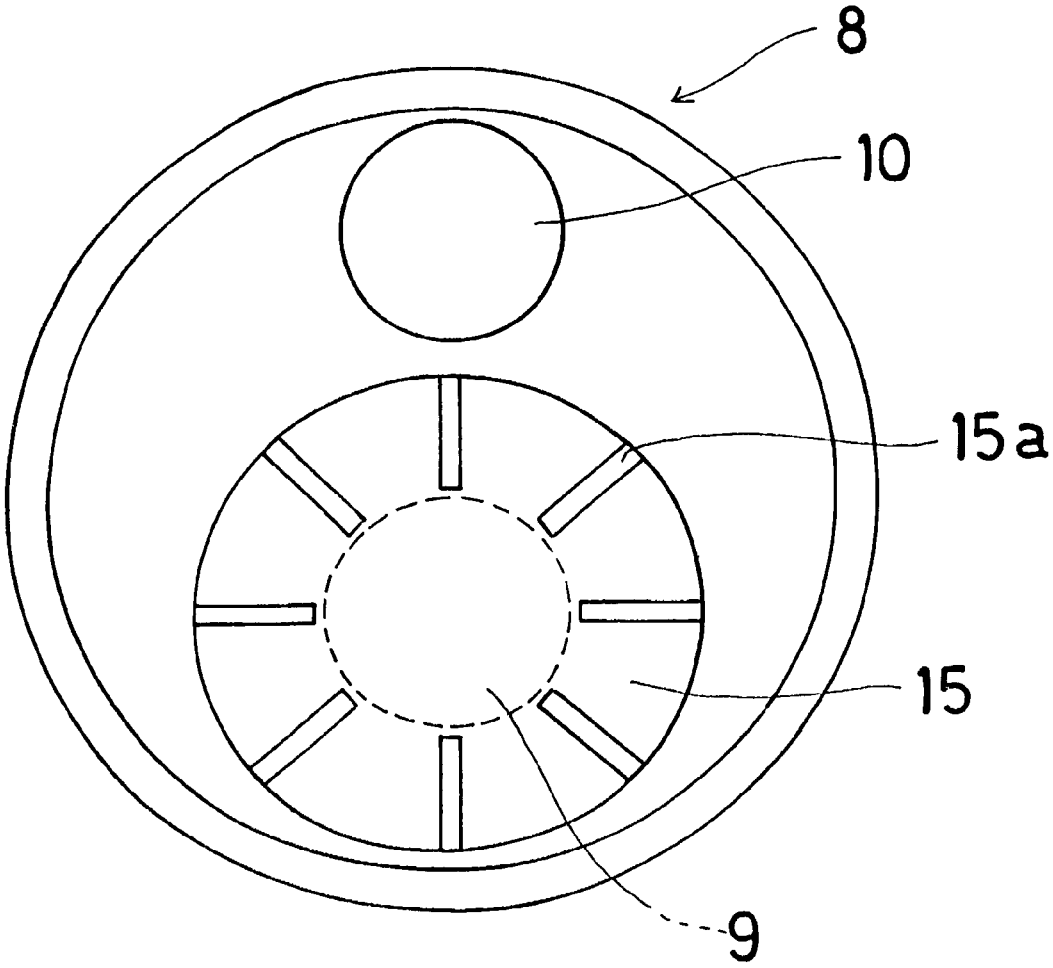
FIG. 4 is a side view taken in the direction of an arrow A in FIG. 3.

A mode of embodiment of the present invention will now be described with reference to the drawings. FIGS. 1 to 4 are drawings showing the cooling water circulating apparatus of a mode of embodiment of the present invention, wherein FIG. 1 is a system diagram of a cooling water circulating apparatus 1, FIG. 2 a sectional view of a first water pump, FIG. 3 is a sectional view of a second water pump, and FIG. 4 is a characteristic diagram of the second water pump.

The cooling water circulating apparatus 1 is an apparatus for circulating cooling water through an engine 2 and a radiator 3, and provided with a first water pump 4 which has a first supply port 5 for supplying cooling water flowing through the engine 2, and a first discharge port 6 for discharging the supplied cooling water to the engine 2 again, and which is connected to and rotated with a cam shaft 2A (two-dot chain lines in FIG. 2) of the engine 2, a thermostat 7 as a control mechanism adapted to cut off a flow of the cooling water which is supplied from the radiator 3 to the first supply port 5 when the temperature of the cooling water is not higher than a predetermined level, and communicate the radiator 3 and first supply port 5 when the temperature of the cooling water is higher than a predetermined level, and a second water pump 8 which has a second supply port 9 for supplying the cooling water flowing through the interior of the engine 2, and a second discharge port 10 for discharging the supplied cooling water toward the first supply port 5 of the first water pump 4, and which is not rotated when the temperature of the cooling water is not higher than a predetermined level, and rotated electrically when the temperature of the cooling water is higher than a predetermined level, the cooling water being circulated through the interior of the radiator 3 in accordance with the temperature of the cooling water.

The construction of each constituent part will be described in detail. As shown in FIG. 2, the firewater pump 4 is formed of a driving shaft 11 rotated with the cam shaft 2A, a rotor 12 mounted on a free end portion of the driving shaft 11, first supply port 5 for supplying the cooling water therefrom, and the first discharge port 6 for discharging the supplied cooling water to the engine 2, and this water pump 4 is rotated with the same rotational frequency as the cam shaft 2A, i.e., with a rotational frequency ½ of that of the crankshaft.

As shown in FIG. 3, the second water pump 8 is a DC brushless motor provided with a metal rotor 15 for sucking and discharging the cooling water, a rotary shaft 17 which has the rotor 15 mounted fixedly on a free end portion thereof, and is which is rotated with the rotor 15, a housing 18 fixed to the engine 2, bearings 19, 20 supporting the rotary shaft 17 on the housing 18 so that the rotary shaft 17 can be rotated relatively to the housing 18, a magnet 16 formed on an outer circumferential surface of the rotary shaft 17, cores 21 arranged on an inner circumference of the housing 18, and a plurality of coils 22 wound around each core 21 and forming a magnetic circuit with the magnet 16. The second water pump 8 is formed so that, when an electric current flows in the coils 22, the rotary shaft 17 is rotated with the magnet 16 when the rotor 15 also rotated, whereby the cooling water flowing from the second supply port 9 is discharged from the second discharge port 10. The rotational frequency of the rotor 15 can be varied arbitrarily within the volume of the pump in accordance with the level of the electric current flowing in the coils 22. In this mode of embodiment, a CPU (not shown) rotates the second water pump 8 by controlling the electric current, which flows in the coils 22, in accordance with the temperature of the cooling water.

The construction of the second water pump 8 will further be described with reference to FIG. 4. As shown in FIG. 4, the second discharge port 10 is formed so as to deviate from the center of rotation of the rotor 15, and blades 15*a* of the rotor 15 so as to extend radially with respect to the mentioned center of rotation. The direction of rotation of the rotary shaft 17 is switched by changing the direction of the electric current I flowing in the coils 22.

In the cooling water circulating apparatus 1 in this mode of embodiment, a hot water type heater 23 is provided between the engine 2 and second supply port 9, and the warmed cooling water is subjected to heat exchange in the heater 23, a blower (not shown) being operated to warm the interior of a vehicle. Since the second water pump 8 is electrically driven, the rotational frequency can be controlled with a high accuracy, and a flow rate of the cooling water sent to the heater 23 is secured, so that the performance of the heater is improved.

The thermostat 7 is a wax type thermostat adapted to switch the circulation and cut off of the cooling water, which is sent from the radiator 3 to the first water pump 4, from one to the other by utilizing the expansion and contraction, which occur in accordance with the temperature of thermowax.

The operation of the cooling water circulating apparatus 1 will be described. When the engine 2 is started and causes the driving shaft 11 and the rotor 12 of the first water pump 4 to be rotated in accordance with the rotation of the cam shaft 2A, the cooling water is supplied from the first supply port 5 owing to pumping actions of the first water pump 4, and the supplied cooling water is discharged toward the first discharge port 6.

When the temperature of the cooling water during a cooling operation is lower than a predetermined level, the cooling water is not circulated in the radiator 3 so as to rapidly warm the engine 2. In this case, the thermostat 7 is closed to cut off the flow of cooling water from the radiator 3 to the first supply port 5. The second water pump 8 is not rotated. During this time, the cooling water is discharged from the first discharge port 6 of the first water pump 4 into the interior of the engine 2, and flows in the interior of the engine 2 and then into the supply port 9 of the second water pump 8 via the heater 23. Since the second water pump 8 is not rotated, the cooling water flows from the second supply port 9 into the second discharge port 10, and then into the first supply port 5 of the first water pump 4, and the cooling water is thereafter discharged from the first discharge port 6 owing to the pumping actions. The cooling water discharged from the first discharge port 6 flows into the interior of the engine 2, and then returns to the first supply port 5 via the thermostat 7, the resultant cooling water being then circulated in the interior of the engine 2 again. This operation is repeated until the temperature of the cooling water reaches a predetermined level.

When the temperature of the cooling water in the engine 2 in this condition becomes not lower than a predetermined level, it is necessary to regulate this temperature so as to maintain the temperature of the water in the engine 2 at a predetermined level. In this case, the thermostat 7 is opened, and the radiator 3 and first supply port 5 communicate with each other, so that the cooling water cooled in the radiator 3 is supplied to the first water pump 4 with the cooling water circulated through the engine 2. The cooling water flowing through the interior of the engine 2 and warmed is sent to the heater 23, and then passes through the second supply port 9 of the second water pump 8, the resultant cooling water being discharged from the second discharge port 10 thereof. The cooling water is then supplied to the first supply port 5 of the first water pump 4, and to the interior of the engine 2 again. Therefore, the cooling water cooled by the radiator 3 and heater 23 is supplied to the engine 2, and the temperature of the water in the engine 2 is thereby maintained at a suitable level. Since the second water pump 8 is driven when the temperature of the cooling water attains a level not lower than a predetermined level, the pump head of the cooling water circulating apparatus 1 as a whole becomes equal to the sum of the pump head of the first water pump 4 and that of the second water pump 8, and a flow rate of the cooling water to the engine 2 and radiator 3 is secured.

According to this mode of embodiment, using the electrically driven second water pump 8 makes it possible to secure a flow rate of the cooling water circulated through the radiator 3 and engine 2, without increasing the head of the first water pump 4 rotated with the camshaft 2A. This enables the fuel consumption to be improved.

Moreover, in this mode of embodiment, the second discharge port 10 of the second water pump 8 is formed so as to deviate from the center of rotation of the rotor 15, and the blades 15*a* of the rotor 15 so as to extend radially with respect to the same center of rotation. Accordingly, it becomes possible to control the flow of the cooling water by rotating the rotor 15 both forward and backward. Owing to this construction, the cooling water flows, from the second water pump 8 to the first water pump 4 without passing through the thermostat 7 when the cooling water flowing out from the engine 2 is sent to the first water pump 4. Therefore, the thermostat 7 can be formed so that the cooling water flowing out from the engine 2 is not supplied thereto. This enables one of the valves of the thermostat 7 to be omitted, and the resistance of the cooling water exerted on the thermostat 7 to be lowered, whereby the durability of the thermostat 7 is improved.

According to the first aspect of the invention, when the cooling water is circulated through both the engine and radiator, the electrically driven second water pump is rotated, whereby the circulation of the cooling water is carried out at a required flow rate. Therefore, when the driving of the first water pump alone causes a discharge rate of the cooling water to become short, the second water pump is rotated to enable the shortage of the discharge rate to be filled up. Owing to this operation, a suitable quantity of cooling water can always be circulated. Since the second water pump is electrically driven, the rotational frequency can be controlled, and the flow rate of the cooling water can also be arbitrarily regulated.

According to the second invention, the cooling water is circulated at a required flow rate through both the engine and radiator by rotating the electrically driven second water pump. Therefore, it becomes possible to secure a required flow rate of the cooling water without increasing the dimensions of the first water pump even when the first water pump is driven with the cam shaft, this invention thus proving to be preferable.

A mode of embodiment of the present invention has been described above. The cooling water circulating apparatus according to the invention is not intended to be limited to the above-described mode of embodiment. Any mode of embodiment is within the scope of the present invention as long as it is in agreement with the gist of the invention as described in the claims appended hereto.

What is claimed is:

1. A cooling water circulating apparatus adapted to circulate cooling water through an engine or a radiator, comprising:

a first water pump which has a first supply port for supplying thereinto cooling water which is to flow through the interior of an engine, and a first discharge port for discharging therefrom the supplied cooling water to the engine, again, and which is directly connected to and rotated with a cam shaft of the engine;

a control mechanism adapted to cut off a flow of the cooling water, which is directed from a radiator to the first supply port, when the temperature of the cooling water is not higher than a predetermined level, and communicate the radiator and first supply port with each other when the temperature of the cooling water is higher than the predetermined level; and a second water pump which has a second supply port for supplying thereinto cooling water which is to flow through the interior of the engine, and a second discharge port for discharging therefrom the supplied cooling water to the supply port of the first water pump, and which is electrically rotated in accordance with the temperature of the cooling water.

2. A cooling water circulating apparatus according to claim 1, wherein the second water pump is not rotated when the temperature of the cooling water is not higher than the predetermined level, and electrically rotated when the temperature of the cooling water is higher than the predetermined level.

3. A cooling water circulating apparatus according to claim 1, wherein a heater is provided between the engine and the second supply port of the second water pump.

4. A cooling water circulating apparatus according to claim 1, wherein blades of a rotor of the second water pump are formed so as to extend radially with respect to the center of rotation of the rotor, the direction of rotation of the rotor being able to be switched from a forward direction to a backward direction, and vice versa.

5. A cooling water circulating apparatus according to claim 4, wherein the second discharge port of the second water pump is formed in the portion thereof which deviates from the center of rotation of the rotor thereof.

6. A cooling water circulating apparatus adapted to circulate cooling water through an engine or a radiator, comprising:

a first water pump which has a first supply port for supplying thereinto cooling water which is to flow through the interior of an engine, and a first discharge port for discharging therefrom the supplied cooling water to the engine, again, and which is connected to and rotated with a cam shaft of the engine;

a control mechanism adapted to cut off a flow of the cooling water, which is directed from a radiator to the first supply port, when the temperature of the cooling water is not higher than a predetermined level, and communicate the radiator and first supply port with each other when the temperature of the cooling water is higher than the predetermined level; and a second water pump which has a second supply port for supplying thereinto cooling water which is to flow through the interior of the engine, and a second discharge port for discharging therefrom the supplied cooling water to the supply port of the first water pump, and which is electrically rotated in accordance with the temperature of the cooling water, wherein the first water pump is located adjacent to the cam shaft of the engine but apart from other auxiliary apparatuses driven by the engine via a belt or a chain so as to obtain space and design flexibility for the cooling water circulating apparatus.

* * * * *